US008480518B2

(12) United States Patent
Kohler et al.

(10) Patent No.: US 8,480,518 B2
(45) **Date of Patent: *Jul. 9, 2013**

(54) CLIMATE VARIABLE LACROSSE HEADS AND RELATED METHODS OF USE

(71) Applicant: Warrior Sports, Inc., Warren, MI (US)

(72) Inventors: Dale W. Kohler, Metamora, MI (US); Joshua G. Schmidt, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/746,237

(22) Filed: Jan. 21, 2013

(65) Prior Publication Data

US 2013/0130847 A1 May 23, 2013

Related U.S. Application Data

(63) Continuation of application No. 13/560,387, filed on Jul. 27, 2012, now Pat. No. 8,376,880, which is a continuation of application No. 12/780,530, filed on May 14, 2010, now Pat. No. 8,267,814.

(60) Provisional application No. 61/178,555, filed on May 15, 2009, provisional application No. 61/259,849, filed on Nov. 10, 2009.

(51) Int. Cl.
*A63B 59/02* (2006.01)
*A63B 65/12* (2006.01)

(52) U.S. Cl.
USPC ..... 473/513

(58) Field of Classification Search
USPC ..... 473/505, 512, 513; D21/724
See application file for complete search history.

(56) References Cited

U.S. PATENT DOCUMENTS 236,045 A 12/1880 Kreutzer
1,555,164 A 9/1925 Schwartz (Continued)

FOREIGN PATENT DOCUMENTS

GB 0424742 2/1935
JP 2000-61005 2/2000

OTHER PUBLICATIONS

Web page download, Devco Design and Development, 1998, http://devco-design.com/mi-mold.htm, 3pp.

(Continued)

*Primary Examiner* — Gene Kim
*Assistant Examiner* — M Chambers
(74) *Attorney, Agent, or Firm* — Warner Norcross & Judd LLP

(57) ABSTRACT

A first lacrosse head constructed from a first material having first properties or a second lacrosse head constructed from a second material having second properties is selectively used in lacrosse activities, based on environmental conditions, such as temperature, humidity and/or solar activity, to provide generally consistent head performance as perceived by a lacrosse player across a range of environmental conditions. The first and second heads can be identical in structure, but constructed from different materials. For example, the first head can include a polyamide, optionally, Nylon 6,6 polyamide, and the second head can include a high performance polyamide resin, optionally a polypthalamide. An environmental indicator that provides visual and/or audible output with regard to environmental conditions can be included with at least one of the first head, the second head and a shaft to which the heads can be joined. Related methods of use are also provided.

16 Claims, 13 Drawing Sheets

U.S. PATENT DOCUMENTS

| | | | |
|---|---|---|---|
| 1,611,858 | A | 12/1926 | Middlekauff |
| 1,750,644 | A | 3/1930 | Norton |
| 2,274,788 | A | 3/1942 | Hatton |
| 3,479,030 | A | 11/1969 | Merola |
| 3,701,374 | A | 10/1972 | McGillvary |
| 3,910,578 | A | 10/1975 | Brine, Jr. |
| D248,679 | S | 7/1978 | Rule |
| 4,098,508 | A | 7/1978 | Gandy |
| 4,119,313 | A | 10/1978 | Popplewell et al. |
| 4,129,635 | A | 12/1978 | Yasuike et al. |
| 4,310,368 | A | 1/1982 | Urquiaga |
| D263,249 | S | 3/1982 | Rule |
| D265,845 | S | 8/1982 | Brine, Jr. et al. |
| 4,374,590 | A | 2/1983 | Everlith et al. |
| D277,691 | S | 2/1985 | Rule |
| D286,666 | S | 11/1986 | Brine, Jr. |
| D286,803 | S | 11/1986 | Brine, Jr. |
| 4,683,784 | A | 8/1987 | Lamont |
| 4,830,812 | A | 5/1989 | Kauer |
| 5,028,377 | A | 7/1991 | Hendry |
| 5,048,843 | A | 9/1991 | Dorfi et al. |
| 5,054,790 | A | 10/1991 | Brine et al. |
| 5,075,056 | A | 12/1991 | Umlauft et al. |
| 5,118,455 | A | 6/1992 | Loren |
| 5,261,665 | A | 11/1993 | Downey |
| 5,269,532 | A | 12/1993 | Tucker et al. |
| 5,421,574 | A | 6/1995 | Yamagishi et al. |
| 5,568,925 | A | 10/1996 | Morrow et al. |
| D376,183 | S | 12/1996 | Morrow et al. |
| 5,651,549 | A | 7/1997 | Dill et al. |
| 5,685,791 | A | 11/1997 | Feeney |
| 5,935,026 | A | 8/1999 | Dill et al. |
| 5,957,791 | A | 9/1999 | Nichols et al. |
| 5,967,912 | A | 10/1999 | Hexemer et al. |
| 6,066,056 | A | 5/2000 | Morrow |
| 6,213,901 | B1 | 4/2001 | Collinson |
| 6,561,932 | B2 | 5/2003 | Morrow et al. |
| 6,595,713 | B1 | 7/2003 | Wilson |
| RE38,216 | E | 8/2003 | Morrow et al. |
| 6,676,547 | B1 | 1/2004 | Morrow et al. |
| 6,723,134 | B2 | 4/2004 | Tucker, Sr. |
| 6,852,047 | B2 | 2/2005 | Tucker, Sr. |
| 6,902,501 | B2 | 6/2005 | Morrow et al. |
| 6,916,259 | B2 | 7/2005 | Kohler et al. |
| 6,921,347 | B1 | 7/2005 | Morrow et al. |
| 6,926,628 | B2 | 8/2005 | Morrow et al. |
| 6,929,572 | B2 | 8/2005 | Morrow et al. |
| 6,994,640 | B2 | 2/2006 | Morrow et al. |
| 7,101,294 | B2 | 9/2006 | Tucker, Sr. |
| 7,131,919 | B2 | 11/2006 | Kohler et al. |
| 7,226,374 | B2 | 6/2007 | Morrow et al. |
| 7,238,128 | B1 | 7/2007 | Filice et al. |
| 7,258,634 | B2 | 8/2007 | Morrow et al. |
| 7,264,562 | B2 | 9/2007 | Morrow et al. |
| RE40,182 | E | 3/2008 | Morrow |
| 7,357,739 | B2 | 4/2008 | Montano et al. |
| 7,547,261 | B2 | 6/2009 | Morrow et al. |
| 7,563,184 | B2 | 7/2009 | Morrow et al. |
| D598,508 | S | 8/2009 | Schmidt |
| D598,509 | S | 8/2009 | Winningham |
| D599,420 | S | 9/2009 | Winningham |
| D599,866 | S | 9/2009 | Winningham |
| D601,212 | S | 9/2009 | Winningham |
| 7,591,744 | B2 | 9/2009 | Morrow et al. |
| D601,646 | S | 10/2009 | Schmidt |
| D601,647 | S | 10/2009 | Winningham |
| 7,618,335 | B2 | 11/2009 | Brown et al. |
| 8,052,549 | B2 | 11/2011 | Sykora |
| 8,267,814 | B1 * | 9/2012 | Kohler et al. ..... 473/513 |
| 8,376,880 | B1 * | 2/2013 | Kohler et al. ..... 473/513 |
| 2002/0098924 | A1 | 7/2002 | Houser et al. |
| 2004/0063522 | A1 | 4/2004 | Wolf |
| 2004/0072638 | A1 | 4/2004 | Enos et al. |
| 2005/0215359 | A1 | 9/2005 | Gait |
| 2006/0276274 | A1 | 12/2006 | Tucker, Sr. |
| 2007/0259742 | A1 | 11/2007 | McCauley, Jr. |
| 2007/0270254 | A1 | 11/2007 | Morrow et al. |
| 2007/0270255 | A1 | 11/2007 | Morrow et al. |
| 2008/0026884 | A1 | 1/2008 | Morrow et al. |

OTHER PUBLICATIONS

Web page download, Plastics Technology, Apr. 5, 2006, www.plasticstechnology.com/articles/article_print1.cfm, 2 pp.

Web page download, Nitrojection, Apr. 5, 2006, www.nitrojection.com, 4 pp.

Web page download, Bayer, Apr. 5, 2006, www.bayerone.com, 6 pp.

Web page download, e-lacrosse, 2001, wayback.archive.org/web/20010715000000*/http://www.e-lacrosse.com/stech32.html, 12 pp.

* cited by examiner

| Optional First Material: High Performance, Polyamide 66 Resin | | |
|---|---|---|
| Properties | Value | Comments |
| Density | 0.0387 lb/in$^3$ | DAM; ISO 1183 |
| Water Absorption | 1.10% | Immersion 24h (DAM); ISO 62, Similar to |
| Tensile Strength, Yield | 6380 psi 73.4 °F | @50% Strain (50% RH); ISO 527 |
| | 6960 psi 73.4 °F | DAM; ISO 527 |
| | 7110 psi 73.4 °F | @50% Strain (DAM); ISO 527 |
| Elongation at Break | >=50.0% 32.0 °F | 50%RH; ISO 527 |
| | >=50.0% 73.4 °F | 50%RH; ISO 527 |
| | >=50.0% 140.0 °F | 50%RH; ISO 527 |
| Elongation at Yield | >=50.0% 73.4 °F | 50%RH; ISO 527 |
| | >=50.0% 140.0 °F | DAM; ISO 527 |
| | >=50.0% 32.0 °F | 50%RH; ISO 527 |
| Tensile Modulus | 246.3 ksi 32.0 °F | 50%RH; ISO 527 |
| | 290 ksi 73.4 °F | DAM; ISO 527 |
| | 315.6 ksi 32.0 °F | DAM; ISO 527 |
| Flexural Modulus | 98.9 ksi 73.4 °F | 50%RH; ISO 178 |
| | 194 ksi 32.0 °F | 50%RH; ISO 178 |
| | 261 ksi 73.4 °F | DAM; ISO 178 |
| | 276.3 ksi 32.0 °F | DAM; ISO 178 |
| Izod Impact, Notched (ISO) | 34.7 ft-lb/in$^2$ 73.4 °F | DAM; ISO 180/1A |

| Optional Second Material: Polyphthalamide (PPA) | | |
|---|---|---|
| Properties | Value | Comments |
| Density | 0.0408 lb/in$^3$ | DAM; ISO 1183 |
| Water Absorption | 0.730% | Immersion 24h, 2.0 mm (DAM); ISO 62, Similar to |
| Tensile Strength, Ultimate | 10200 psi 73.4 °F | DAM; ASTM D 638 |
| Tensile Strength, Yield | 8990 psi 73.4 °F | DAM; ISO 527 |
| Elongation at Break | 9860 psi 73.4 °F | 50%RH; ISO 527 |
| | 10.0% | 50%RH; ISO 527 |
| | 14.0% | DAM; ISO 527 |
| Elongation at Yield | 18.0% 73.4 °F | DAM; ASTM D 638 |
| | 4.40% 73.4 °F | 50%RH; ISO 527 |
| | 5.50% 73.4 °F | DAM; ISO 527 |
| Tensile Modulus | 5.80% 73.4 °F | DAM; ASTM D 638 |
| | 318 ksi 73.4 °F | DAM; ISO 527 |
| Flexural Modulus | 334 ksi 73.4 °F | 50%RH; ISO 527 |
| | 290 ksi 73.4 °F | DAM; ISO 178 |
| Izod Impact Notched (ISO) | 35.7 ft-lb/in$^2$ 73.4 °F | DAM; ISO 180/1A |

Fig. 7

CLIMATE VARIABLE LACROSSE HEADS AND RELATED METHODS OF USE

BACKGROUND OF THE INVENTION

The present invention relates to lacrosse heads, and more particularly, to lacrosse heads for use in varying environmental conditions.

Conventional lacrosse heads typically include an open frame having a ball stop joined with the base, a pair of sidewalls that diverge from the ball stop, and a scoop that connects the sidewalls, opposite the ball stop. The sidewalls generally include a lower portion, such as a lower rim, that defines multiple circular or elliptical string holes. A lacrosse net is strung to the lower rim via the string holes, around the back side of the frame, leaving the opposing side of the frame open for catching or shooting a lacrosse ball.

A number of conventional lacrosse heads are constructed from plastic, and in particular, nylon 6,6 polyamide. One suitable nylon 6,6 polyamide is Zytel® ST801, which is available from E.I. du Pont de Nemours and Company. If designed well, heads constructed from ST801 have good overall strength and resilience, so that they can easily withstand the rigors of lacrosse activities. Generally, heads constructed from ST801 have a relatively constant rigidity, and flex consistently, during shooting or maneuvering a lacrosse ball from or within the heads. This consistency is appealing to lacrosse players because it enables them to shoot, pass and control the ball with predictability—which in turn dictates success.

An issue that arises with heads constructed from ST801 is that while they provide consistent performance in temperatures ranging from 40° F. to about 70° F., their performance can start to wildly vary in temperatures outside this range, which can be common in the game of lacrosse. For example, in many regions, at the end of a typical lacrosse season, many high school and league lacrosse games are played in temperatures that, during late morning and afternoon, can reach well over 100° F. Temperatures in these ranges can, and usually do, affect the properties of ST801 and subsequently the performance of the heads constructed from this material. This can have a notable effect on a player's game.

For a good portion of the lacrosse season in many regions, lacrosse games are played at "lower" temperatures, usually around 50° F. to 70° F. Players become used to the way that their lacrosse head performs in such temperatures, and use specific handling techniques to maximize shooting and cradling. When temperatures climb above 90° F., and in some cases lower temperatures (e.g., above 75° F., above 80° F., or above 85° F.), the ST801 from which the heads are constructed tends to become more elastic and flexible. In turn, the head begins to perform differently for the player.

As an example, when a player shoots a ball with a heated, more flexible head, the ball comes out of the head differently, usually at a slower speed, because the sidewalls flex and "absorb" the force that the player exerts to move the head. This usually results in the trajectory of the ball being shot varying from what the player expects. In many cases, the outcome is that the shot is short or inaccurate. In the intense game of lacrosse, this can be extremely frustrating for the player and their team.

Another issue with ST801 is that is tends to be quite hygroscopic, that is, it tends to attract and hold water from the surrounding environment. In humid regions having relative humidity over 50%-60%, this too can affect head performance. As an example, in many regions, toward the end of the lacrosse season, humidity can climb to above 60%, 70%, 80% and even above 90%. In this high humidity, conventional lacrosse heads tend to absorb water and physically swell, which can both change the dimension of the heads slightly, as well as the rigidity and flexibility of the head. In most cases, the heads tend to become more flexible. Like higher temperatures, this can ultimately affect the performance of the lacrosse head and the player's ability to shoot and maneuver the head consistently. The dimension change can also affect the way the net or pocket of the head is strung on the head. For highly skilled and experienced players, this can be frustrating.

While heads constructed from common plastics perform well in many temperatures and humidity, at higher temperatures and humidity, their performance can change dramatically. This can greatly affect a player's confidence in their lacrosse head, and generally can change the way that the player must utilize and maneuver the head.

SUMMARY OF THE INVENTION

Lacrosse heads are provided that are constructed for use across, and used to enhance performance in, a variety of environmental conditions.

In one embodiment, a first lacrosse head can be constructed from a first material having desired material properties within a first temperature range. A second lacrosse head can be constructed from a second material different from the first material, with the second material having desired material properties within a second temperature range. The first lacrosse head can be used in lacrosse play until a preselected temperature and/or preselected humidity or other environmental condition is reached, above which, the second lacrosse can be used. The first and second heads can be alternatively and selectively joined with a lacrosse shaft, depending on the preselected temperature and/or preselected humidity or other environmental conditions.

In another embodiment, the first lacrosse head can be constructed from nylon 6,6 polyamide, such as Zytel® ST801. The second lacrosse head can constructed from a high performance polyamide resin, optionally a polyamide that is more rigid and less flexible than the first material of the first lacrosse head at temperatures and/or a humidity above the preselected temperature and/or humidity. Optionally, the second material can be a polypthalamide (PPA), for example, Zytel® FE 8200.

In yet another embodiment, the first lacrosse head can include an environmental indicator, such as a temperature or humidity indicator, that indicates a user when temperature is at, above and/or below a preselected temperature, or when the humidity is at, above and/or below a preselected temperature. Optionally, the indicator can be include a sensing device that senses temperature and/or humidity, and provides a visual output to inform the user of the variance. The visual output can be in the form of a change in color or appearance of a portion of the head. Further optionally, the indicator can be in the form of a layer or decal joined with the head and can include a thermochromic ink or material. Alternatively, the head can include a miniature thermometer or humidity sensor in communication with a visual output device.

In still another embodiment, the second lacrosse head also can include an environmental indicator that indicates to a user when an environmental condition, such as temperature or humidity, is at, above and/or below a preselected temperature or humidity. Optionally, the indicator of the first head and second head can work in concert, having a common preselected temperature about which they operate.

In a further embodiment, the indicator of the first head can be set to change from a first color to a second color at, above and/or below a preselected temperature and/or humidity. The indicator of the second head can be set to change from the second color to the first color at, above and/or below the same preselected temperature and/or humidity.

In still a further embodiment, a handle to be associated with either of the first and second lacrosse heads can include an indicator that indicates to a user when an environmental condition, such as temperature or humidity, is at, above and/or below a preselected temperature or humidity. The indicator can include a sensor and output, or a thermochromic component such as those explained above. The indicator can provide an output, for example a first color to second color change, or color-to-colorless or vice versa change at, above and/or below the preselected temperature or humidity. The respective first and second heads can include reference components that can be referenced against the indicator output to determine which head is appropriate to join with the shaft before play.

In yet a further embodiment, a method of using the lacrosse heads in certain environmental conditions is provided. The method includes providing a first head constructed from a first material having a first set of material properties; providing a second head constructed from a second material having a second set of material properties different from the first set; selecting either the first head or the second head based on environmental conditions, and engaging in a lacrosse activity with the selected head. Optionally, the environmental conditions can be one or more of temperature, humidity, and solar activity. Further optionally, the first head or the second head can be alternatively and selectively joined with a lacrosse shaft for play.

In another, further embodiment, a method of using lacrosse heads in certain environmental conditions is provided. The method includes providing first and second lacrosse heads, each having different sets of material properties, where at least one of the heads includes an environmental indicator; selecting either the first head or the second head based on output of the environmental indicator, and engaging in a lacrosse activity with the selected head. Optionally, the first head or the second head can be alternatively and selectively joined with a lacrosse shaft for play.

In yet another, further embodiment, another method is provided. The method includes providing first and second lacrosse heads, each having different sets of material properties, providing a lacrosse handle including an environmental indicator; selecting either the first head or the second head based on output of the environmental indicator, and engaging in a lacrosse activity with the selected head. Optionally, the first and/or second heads can include reference components that can be referenced against the indicator output to determine which head is appropriate to join with the shaft before play.

The lacrosse head and method of use provided herein provides lacrosse players with a superior mechanism to accurately select a head appropriate for the environmental conditions in which it is to be used. Accordingly, a lacrosse player can use heads which provide the desired consistency in handling, which in turn can improve the player's overall performance.

These and other objects, advantages, and features of the invention will be more fully understood and appreciated by reference to the description of the current embodiment and the drawings.

BRIEF DESCRIPTION OF THE DRAWINGS

FIG. 7 illustrates certain material properties of first and second materials that optionally may be used to construct the first lacrosse head and the second lacrosse head, respectively;

DESCRIPTION OF THE CURRENT EMBODIMENT

I. Overview

Figure 1:
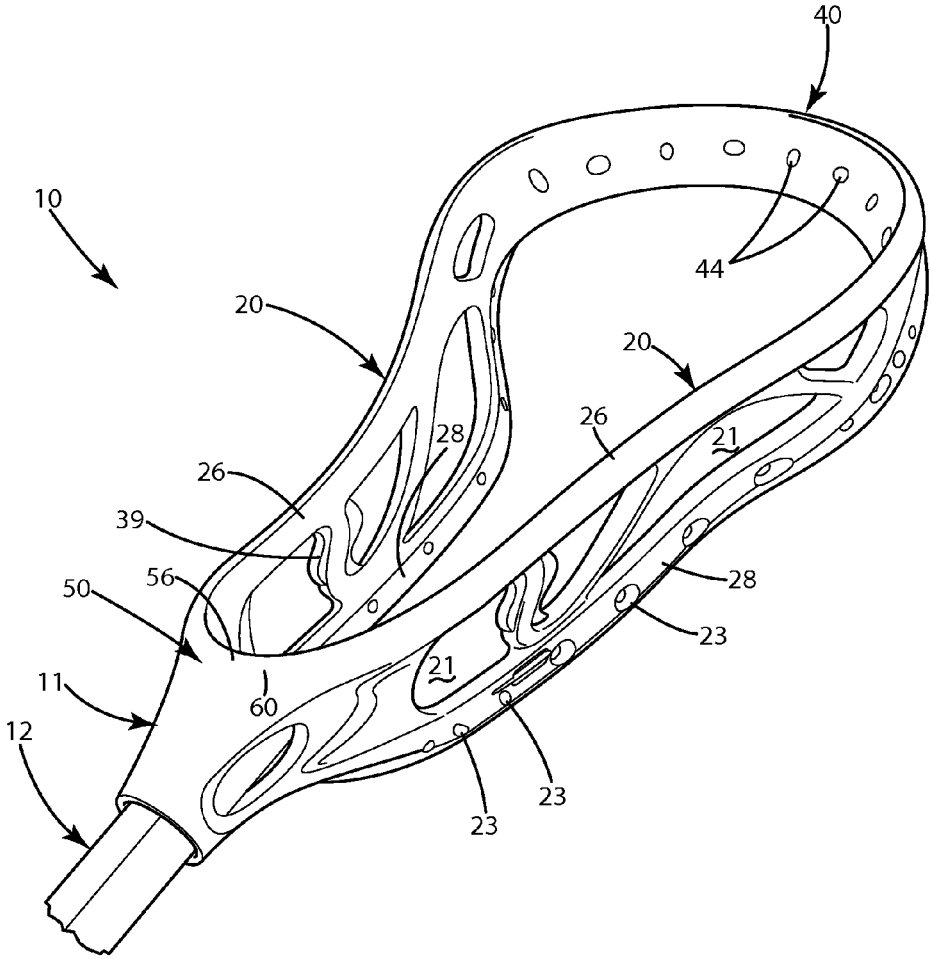
FIG. 1 is a perspective view of a current embodiment of a lacrosse head.
Figure 2:
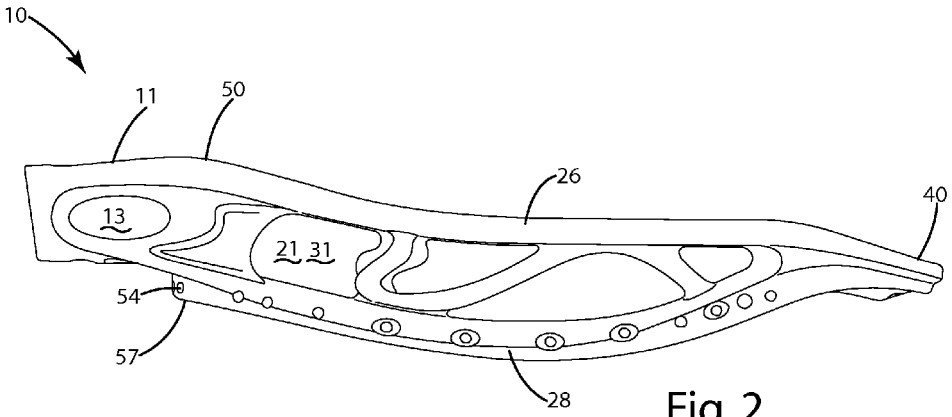
FIG. 2 is a side view of the lacrosse head.
Figure 3:
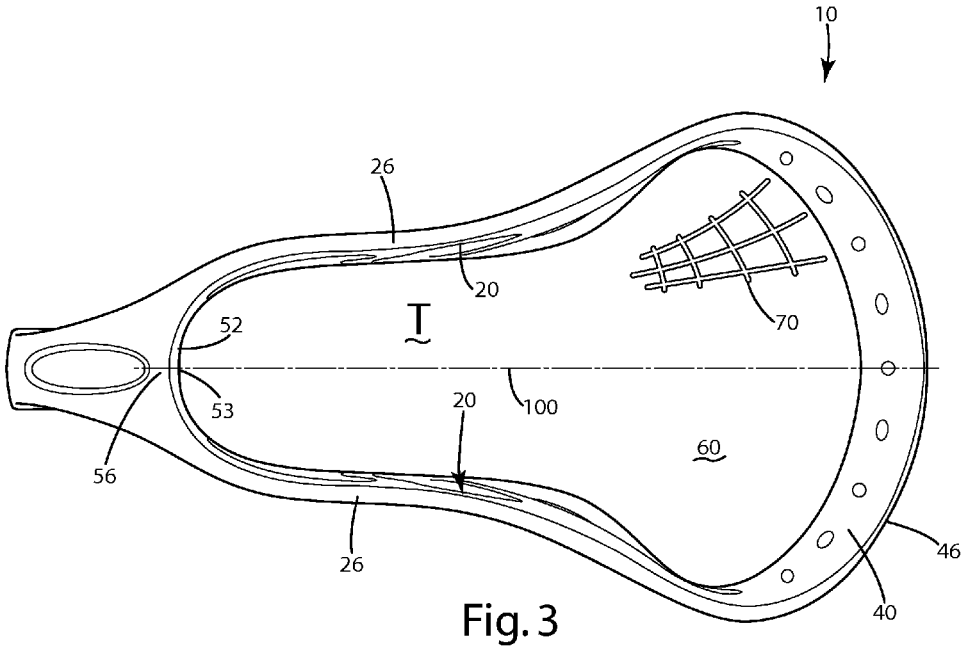
FIG. 3 is a top view of the lacrosse head.

A current embodiment of an exemplary lacrosse head is shown in FIGS. 1-3 and generally designated 10. The lacrosse head 10 includes a throat 11 adapted to connect to a lacrosse handle 12, a pair of opposing sidewalls 20 and a scoop 40 connecting the pair of opposing sidewalls 20 opposite the throat 11. Located at the lower end of the head, adjacent the throat 11, is a base 50 which includes a ball stop 52. The sidewalls 20 can be of an open frame construction, that is, they can define at least one non-string hole that is adapted to reduce the weight of the head, such as the frame hole 21. Each sidewall can also include an upper rail 26 and a lower rail 28 separated from one another by a distance.

Figure 4:
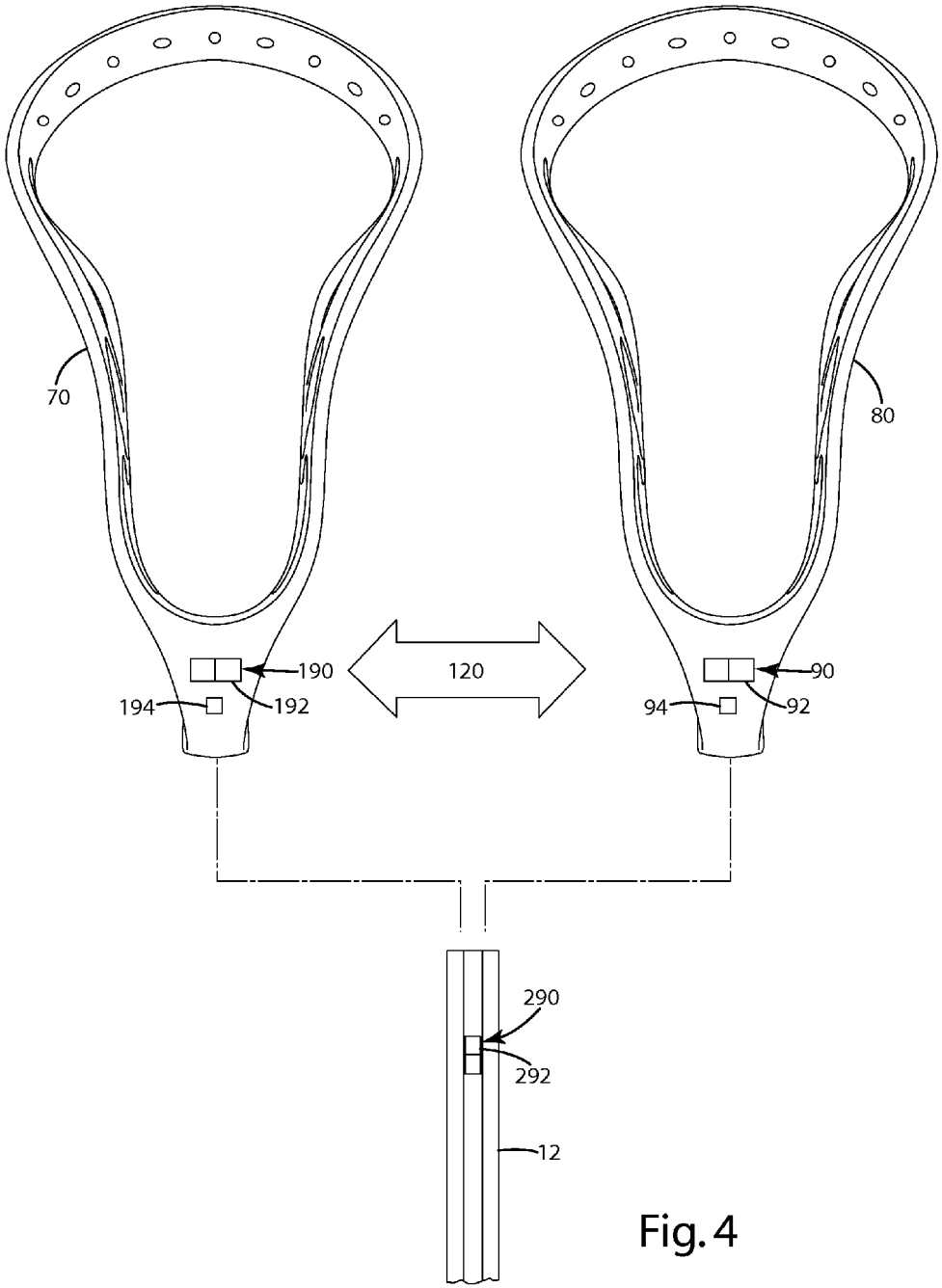
FIG. 4 is a plan view of first and second lacrosse heads being selected based on environmental conditions according to a current embodiment.

The structure of the exemplary lacrosse head 10 can be duplicated in different materials so that a first lacrosse head constructed from a first material is substantially identical in structure to a second lacrosse head constructed from a second material different from the first material. As an example, as shown in FIG. 4, the lacrosse head 70 can be constructed from a first plastic, and the second lacrosse head 80 can be constructed from a second plastic, having different material properties from the first plastic at the same or under different environmental conditions as discussed below. The first and second heads 80 can still be substantially identical in physical structure, for example, the scoop, sidewalls and throat can be of the same dimensions and structure, within certain manufacturing tolerances.

Depending on the environmental conditions, such as temperature, relative humidity, solar activity, etc., a player can select either the first head 70 or the second head 80 and use it in a lacrosse activity. In making the selection, the player can evaluate an environmental condition, for example, by reviewing or taking a temperature reading. The player can compare the reading to a preselected temperature above or below which a certain head works better. Alternatively, the player can compare the temperature reading to prescribed ranges of temperatures provided by a manufacturer in which the first and second heads operate well. The player can select the head having a range within which the reading falls.

To assist the player in making a head selection, the heads and/or the shaft to which the heads may be connected can include an environmental indicator. The environmental indicator can provide output, such as a color change, or color-to-colorless change, or vice versa, indicative of the head's suitability for play under certain environmental conditions as described below.

II. Construction

The general construction of the exemplary head 10 will now be described briefly with reference to FIGS. 1-3. As depicted, the throat 11 can extend from the base 50, and can define a socket 13. The socket 13 can be tubular in shape and can define a cavity to receive a handle 12. Alternatively, the throat 11 can include a projection which is adapted to fit within a handle. The handle 12 can be secured within the socket 13, optionally by a fastener (not shown), such as a screw, peg, or other fastening devices or materials such as adhesives. Optionally, the socket 13 can define apertures or holes (not shown) to reduce the weight of the head.

As shown in FIGS. 1-3, an exemplary head 10 can include a pair of sidewalls 20. These sidewalls can be positioned on opposite sides of a longitudinal axis 100 of the head, which can generally bisect the head in opposing halves. The longitudinal axis 100 can pass directly through the middle portion 53 of the ball stop 52 as described in further detail below. One or both of the sidewalls 20 can extend generally from the ball stop 52 toward the scoop 40, which is located at the opposite end of the head 10.

Each sidewall can include upper rails 26 and lower rails 28. These rails can be secured to and extend between the base 50 and the scoop 40. Alternatively, these upper and lower rails can be an extension of the base 50. Referring to FIG. 3, the upper rails 26 can follow an outward curvilinear path near the base 50 before extending generally parallel to the central longitudinal axis 100 along a portion of its length, generally within the throat T of the head. The throat T can generally extend from the ball stop 50 to ½ to ⅔ the length of the ball receiving area 60 of the head, or other distance as desired. Optionally, the upper and lower rails can be of a circular, polygonal, elliptical, rectangular, or beveled cross-sections that are generally uniform that or vary as these elements extend from the base 50 to the scoop 40.

With reference to FIGS. 1-2, the sidewalls can be of an open frame construction, defining one or more non-string apertures 21 between the upper and lower rails. These apertures can be of any preselected shape, and can be configured for structural or aesthetic purposes as desired. In addition to the non-string holes, the sidewalls and other portions of the head optionally can include multiple string holes, such as the ball stop holes 54 and the scoop holes 44 that allow attachment of a net 70 to the head 10. The precise placement of these string holes can vary as desired.

The sidewalls 20, and particularly the upper rails 26 can join with an upper rim 56 of the ball stop 50, as well as an upper ball stop rim 46 of the scoop 40. This bounded region can generally define a ball receiving area 60, which is where a lacrosse ball can enter or exit the head 10 when the ball is caught, thrown, shot or dislodged. Opposite the ball receiving area, the sidewall lower rim 28, scoop lower rim 47 and lower ball stop rim 57 can also define a lower bounded region, which can define a ball retaining area. This is where a lacrosse ball typically is located when retained in the head 10 and more particularly in the net 70 attached to the head 10.

The first material used to construct the first head 70 and the second material used to construct the second head 80, shown in FIG. 4, can vary widely. Generally, such materials can include nylon, urethane, polycarbonate, polyethylene, polypropylene, polyketone, polybutylene terephalate or optionally, any of a variety of polyamides. Optionally, the first material can be a first plastic, such as a polyamide, and the second material can be a second plastic that is different from the first polyamide, such as another polyamide, having one of more different material properties. For example, the first material can have an elastic modulus that is greater than (or optionally less than) the elastic modulus of the second material.

In the current embodiment, the first material used to construct the first head 70 can be a plastic, such as a nylon 6,6 polyamide. Such a polyamide can be relatively resilient and not prone to breakage upon deflection, e.g., not very brittle. The first plastic also can have certain material properties. For example, Relative Humidity (RH) and/or Dry As Molded (DAM) the first plastic can optionally have a mechanical property of at least 40% elongation at break, and optionally greater than or equal to 50% elongation at break as measured under ISO 527 testing techniques (which are well known) and measured at 50% Relative Humidity (RH) and/or Dry As Molded (DAM) across a range of temperatures. The first plastic also can have a Tensile Modulus of 230 ksi to 250 ksi, optionally 246 ksi at 32° F. when measured at 50% RH under ISO 527 testing techniques. When measured DAM using ISO 527 testing techniques, the first plastic can have a Tensile Modulus of about 300 ksi to 320 ksi, and optionally 315 ksi when measured at 32° F.

The Flexural Modulus of the first plastic can be in a range of about 190 ksi to 200 ksi at 50% RH using ISO 178 testing techniques (which are well known) at a temperature of 32° F. Optionally, the Flexural Modulus measured under ISO 178 testing techniques DAM can exhibit about 270 ksi to 280 ksi, optionally 276 ksi at a temperature of 32° F.

The first plastic can also exhibit an Izod Impact, Notched test material property, as measured under ISO 180/1A testing techniques (which are well known) of about 34 ft-lb/in$^2$ to about 35 ft-lb/in$^2$, and optionally 34.7 ft-lb/in$^2$ measured DAM, and further optionally 44 ft-lb/in$^2$ at 50% RH.

A suitable material for use as the first plastic in the first lacrosse head 70 is offered under the trade name Zytel® ST801, which is available from E.I. du Pont de Nemours and Company of Wilmington, Del. Additional material properties for an optional polyamide 66 resin, for example, Zytel® ST801, listed by du Pont, are included at FIG. 7.

The mat-erial from which the second head 80 is constructed, that is, the second plastic, can be different from the first plastic. The second plastic can be a homogenous plastic that is void of fibers, strands and reinforcement structures. In general, the second material can be constructed from an unreinforced polyamide, for example, a high performance polyamide that can be adapted for injection molding, and more specifically, a polypthalamide (PPA). The material can exhibit a Tensile Modulus of about 300 to about 330 ksi, optionally about 320 ksi measured DAM using ISO 527 testing techniques at about 73° F. The Flexural Modulus of this material can be about 300 ksi to 340 ksi, optionally about 330 ksi measured at 50% RH using the ISO 527 testing techniques at about 73° F. Further optionally, the Flexural Modulus can be about 280 ksi to about 320 ksi, optionally 290 ksi measured DAM at about 73° F.

The second material can be somewhat brittle at temperatures under about 80° F., which can be generally characterized as a mechanical property where the material does not exhibit much elongation before or at breaking. For example, the second plastic can have an elongation at break as measured under ISO 527 testing techniques of about 5% to about 20%, and optionally about 10% at a 50% RH. When measured DAM, the material can exhibit a 10% to about 20%, optionally about 15% elongation at break.

A suitable material for use as the second plastic in the second lacrosse head 80 is offered under the trade name Zytel® FE8200, which is available from E.I. du Pont de Nemours and Company. Additional material properties for an optional PPA, for example, FE8200, listed by du Pont is included at FIG. 7.

Figure 5:
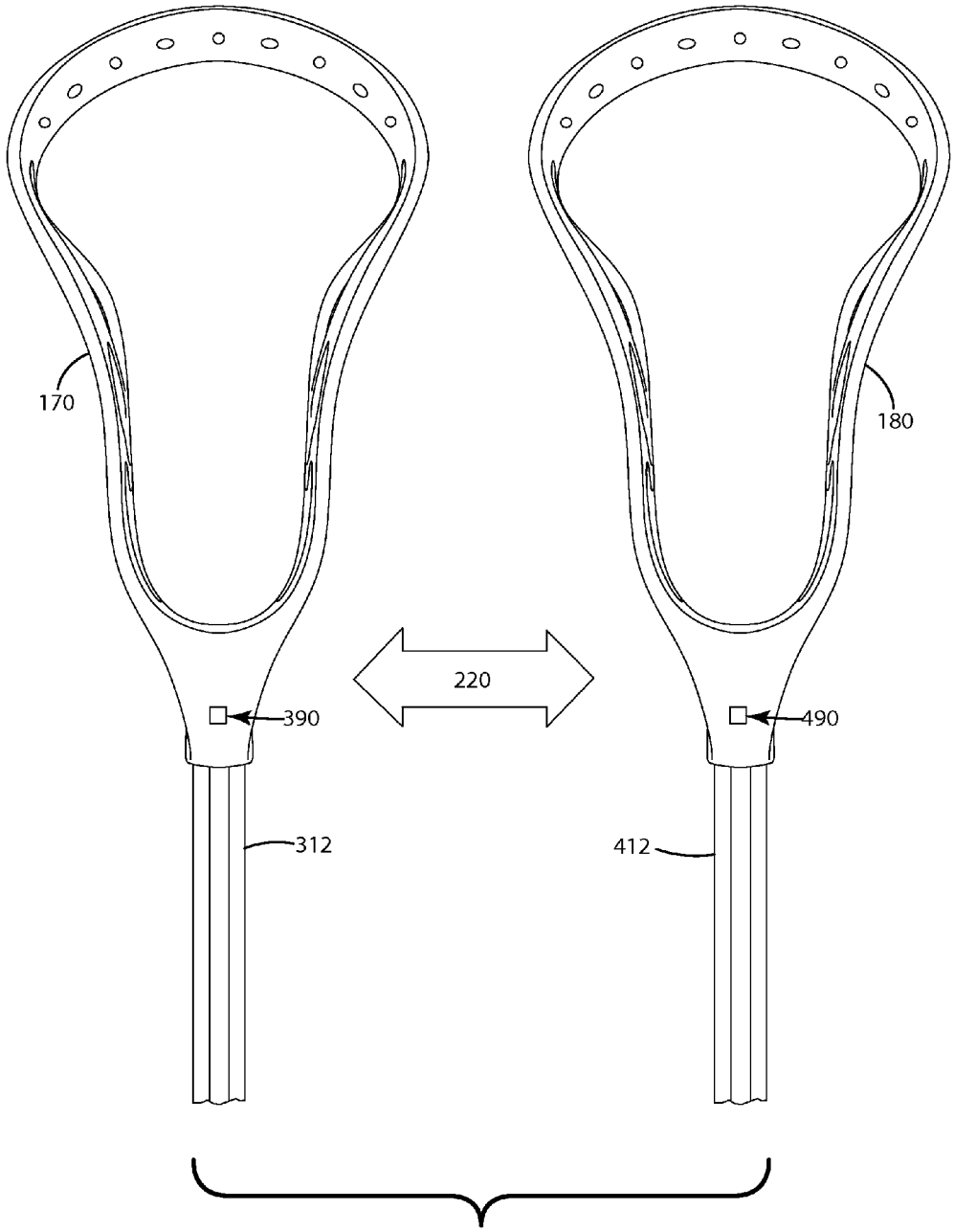
FIG. 5 is a plan view of first and second lacrosse head and handle combinations being selected based on environmental conditions according to another embodiment.

As illustrated in FIGS. 4 and 5, the first and second lacrosse heads 70, 80 optionally can include environmental indicators 190 and 90, respectively. These environmental indicators can sense at least one of the following environmental conditions: temperature, relative humidity, and solar activity. In the embodiments illustrated, the environmental condition sensed and measured can be temperature.

The indicator can also include a visual output that indicates to a user when the respective heads are under certain environmental conditions. For example, the visual output can indicate to a user when the temperature of the environment in which the head is located is at, above and/or below a preselected temperature, or when the humidity is at, above and/or below a preselected temperature. Optionally, the preselected temperature can coincide with the temperature at which the first head material begins to undergo changes, for example, when it starts to become more elastic due to heating in elevated temperatures.

As one example, the preselected temperature can be established so that the indicator provides a particular visual output at or above an ambient about 80° F., optionally about 85° F., further optionally about 90° F., 95° F., 100° F., 105° F., 110° F., 115° F., 120° F., or any other temperature as desired. The indicator can provide a second, different visual output when the ambient temperature is at or below the aforementioned preselected temperatures. For example, the visual output can be a red color when above the aforementioned preselected temperatures and can be a green color when below the aforementioned preselected temperatures.

Optionally, the preselected humidity can coincide with a humidity at which the first head absorbs sufficient water from the atmosphere and begins to undergo physical changes. For example, the head can start to become more elastic as it absorbs water. As another example, the predetermined humidity can be established so that the indicator provides a particular visual output at or above an ambient humidity of about 50%, 60%, 70%, 80%, 90% or 100% humidity, or any other humidity. The environmental indicator can provide a second, different visual output when the ambient humidity is at or below the aforementioned preselected humidity levels. For example, the visual output can be a blinking light when above the aforementioned preselected humidity, and can be a solid light when below the aforementioned preselected humidity.

As another example, the environmental indicator can output visual output based on detected or sensed temperature ranges. The environmental indicator can generate a first visual output when the temperature is within a first temperature range, for example, 40° F. to about 60° F., 70° F., 80° F. or 90° F. and can generate a second visual output when the temperature is within a second temperature range, for example, about 60° F., 70° F., 80° F. or 90° F. to about 115° F. More generally, the environmental indicator can generate a visual or audible output when the temperature exceeds a preselected temperature.

Returning to the second material properties, above the preselected temperature, the second material can become less brittle, maintain its elasticity, and function more like, and have performance characteristics, like deflection and elasticity, of the first material when the first material is at temperatures below the preselected temperature. Due to this performance characteristic change at higher temperatures, a lacrosse player can change from the first lacrosse head to the second lacrosse head above the preselected temperature without noticing or being affected by a change in performance of the head, as would be the case if the player continued to use the first head constructed from the first material at the temperatures above the preselected temperature.

The visual output of the environmental indicator can vary depending on the application. The visual output can be in the form of a change in color, or a change from color-to-colorless (or vice versa), or a change in appearance, or a visual display of the actual temperature—in numeric or graphic form. The visual output can be provided by a portion of the material of the head, or can be provided in the form of a layer, sticker or decal joined with the head. Optionally, the visual output can be provided by a thermochromic ink or other thermally sensitive material or device joined with the head. As an example of a device, the head can include a miniature sensor adapted to sense environmental conditions. The miniature sensor can be joined with a visual output device that provides the desired visual indicia to alert a user that the preselected temperature has been reached, and that a head change is appropriate. Alternatively, the miniature sensor can include a speaker that provides an audible alarm to alert a user that the preselected temperature has been reached, and that a head change is appropriate.

As another example, the environmental indicator can be a decal that is adhered to one or more of the heads 70, 80. The decal can include a thermochromic ink layer having a sensitivity corresponding to the preselected temperature. When the ambient temperature, in which the lacrosse head(s) is being used, is above or below a preselected temperature, the thermochromic ink changes color to indicate to the lacrosse player that it is time to change from the first head to the second head or vice versa.

In the embodiment illustrated in FIG. 4, the first environmental indicator 190 includes visual output 192. The visual output 192 can be a thermochromic ink that changes from green to red (or some other color change) when the temperature reaches a preselected temperature, for example, 95° F. The second environmental indicator 90 can include visual output 92, which changes from red to green (the opposite of the visual output 192) above the preselected temperature. With this combination color change, above the preselected temperature, the first head 70 will have a red visual output 192, while the second head 80 will include a green visual output 92, signifying the player to "stop" playing with the first head 70, and "go" play with the second head 80. Other color changes or color-to-colorless changes are suitable as well.

Optionally, one or both heads can include a temperature gauge that numerically outputs temperature. In which case, the user can read the temperature, and change heads when it reads below, at or above a preselected temperature provided by the manufacturer or one selected by the player.

As indicated by the arrow 120 shown in FIG. 4, the user can switch back and forth between heads 70 and 80 as the temperature changes throughout a game, tournament or even a season. This switch can be performed by removing and installing the temperature appropriate head 70 or 80 on the lacrosse handle 12.

As another option, the lacrosse shaft 12 can include an environmental indicator 290, having its own visual output 292. This environmental indicator 290 can act alone, indicating when a preselected temperature is reached, or in concert with the visual indicators of the heads 70 and 80. Where the shaft visual indicator 290 acts alone, the first and second heads can be void of environmental indicators, but can include a reference component. The reference component can be a colored decal or portion of the head, such as reference components 194 and 94. As an example, the reference component 194 can be a blue decal, while the reference component 94 can be an orange decal. The visual output 292 can be configured to be blue when the temperature is below a preselected temperature, and orange when at or above the preselected temperature. In use, the player will monitor the color of the visual output 292, and ensure that it matches the decals 194, 94 on the respective heads.

It is contemplated that a manufacturer can sell a combination set of the first head 70 and the second head 80 in combination with at least one shaft 12. One or more environmental indicators can be joined with one or more of the first head, second head and at least one shaft. The user of the set will select 120 the appropriate head 70 or 80 to use on the on the shaft 12 depending on the output provided by the environmental indicator(s) on the heads and or the shaft. Alternatively, the heads and shaft(s) can be sold separately, and mixed and matched as desired by the consumer.

In a different embodiment shown in FIG. 5, a first head 170 can be joined with a first shaft 312, while a second head 180 can be joined with a second shaft 412. One or both of the heads or associated shafts can include an environmental indicator 390, 490, that operate like the environmental indicators described above. Based on the output of the indicators, a user can switch back and forth between the complete head/handle combinations in varying temperatures or other varying environmental conditions such as humidity and/or solar activity.

III. Method of Use

Several methods of use of the current embodiment will now be described. In general, the methods include using different lacrosse heads constructed from different materials in varying environmental conditions. The environmental conditions can be any of those explained above with reference to the heads, for example, temperature, humidity and/or solar activity.

In one method, a first head constructed from a first material having a first set of material properties is provided. Optionally, that first material can be a plastic, such as ST801. A second head constructed from a second material having a second set of material properties is provided. Optionally, that second material can be a plastic, such as FE8200. Either the first head or the second head is selected based on environmental conditions. For example, if the temperature is at or above 90° F., the second head is selected. As another example, if the temperature is below 90° F., the first head is selected. With the appropriate lacrosse head selected, a user can engage in a lacrosse activity with the selected head.

In yet another method, first and second lacrosse heads are provided. Each head can have different sets of materials properties, such as those explained above. In this method, a user checks an environmental indicator, such as a thermometer in the area where the player is engaged in a lacrosse activity or a humidity sensor in the same area. Based on the output of the thermometer and/or humidity sensor, which can be separate from the head, either the first head or the second head can be selected based on the output of the respective thermometer and/or humidity sensor. With the appropriate lacrosse head selected, the user can engage in a lacrosse activity with a selected head.

In still another method, first and second lacrosse heads are provided. Each head can have different sets of material properties, such as those explained above. At least one of the heads can include an environmental indicator, such as the ones explained above. Based on the output of the environmental indicator, either the first head or the second head can be selected. With the appropriate lacrosse head selected, a user can engage in a lacrosse activity with the selected head.

In yet another method, first and second lacrosse heads, each having different sets of material properties, are provided. A lacrosse handle including an environmental indicator is also provided. Based on indicator output generated by the environmental indicator, either the first head or the second head is selected, and optionally attached to the lacrosse handle so that a user can engage in a lacrosse activity. Further optionally, where at least one of the first and second heads include reference components, such as those described above, those reference components can be compared to the output of the environmental indicator. Based on that comparison, a user can determine which head is appropriate to join with the shaft before engaging in the lacrosse activity.

In still yet another method, a method of engaging in a lacrosse activity is provided. In this method, the first lacrosse head constructed from the first material, the second lacrosse head constructed from the second material, and a lacrosse handle are provided. The user can select either the first head or the second head based on certain environmental conditions such as temperature, humidity and/or solar activity. The selected head can be joined with a lacrosse handle to transform the lacrosse handle to include the selected head. The player can then engage in lacrosse with a selected head.

Optionally, the first lacrosse head, the second lacrosse head and/or the handle can include an environmental indicator is joined with or included or otherwise incorporated into one of these elements. The environmental indicator can sense an environmental condition such as those noted above. In response to the sensed environmental condition, the environmental indicator can output either a visual or audible signal as explained in the embodiments above in response thereto. The user can perceive such visual and/or audible output, select the appropriate first or second lacrosse head, and then engage in the lacrosse activity.

Further optionally, the environmental conditions may affect the selection of the first or second lacrosse head temperature. As an example, the user can select the first lacrosse head where the temperature is at or below a preselected temperature, and conversely, can select the second lacrosse head when the temperature is at or above the preselected temperature. Preselected temperatures can be any of those noted in the embodiments above.

The visual or audible output from the environmental indicator can correspond to the preselected temperature. For example, the environmental indicator can output the visual or audible output when the ambient temperature is above, at or below the preselected temperature or a particular temperature range as noted above. Alternatively, if the environmental indicator is based on certain other environmental conditions, such as humidity, the environmental indicator can generate a visual or audible output when the humidity is above, at or below a preselected humidity level or range such as those mentioned above.

IV. Comparative Testing

Testing was performed on heads constructed from the first material and heads constructed from the second material. The testing generally measured the deflection of virtually identical heads, constructed from the different materials, at different temperatures, and subject to similarly applied deflection forces. The results of the tests illustrated that at elevated temperatures, heads constructed from a second material, such as FE 8200, deflect less than heads constructed from the first material, such as ST801, particularly at higher temperatures, with the differences in the head deflection becoming somewhat apparent at about 72° F., very apparent at about 90° F., and even further apparent at 105° F. These results indicated that the performance of the first head changes enough that a switch to the second head is appropriate for most lacrosse players to ensure generally consistent performance as perceived by the lacrosse players. This approach of switching heads to maintain consistent performance, was considered highly counterintuitive because lacrosse players many times have a "favorite" head which they play because of its performance characteristics. Shifting to another head simply because of the climate and temperature usually is viewed as being too variable, leading to inconsistent shooting and passing. Surprisingly and unexpectedly, however, the test results indicate that switching from one head constructed from a first material to another head constructed from a different material under different climates and/or temperatures can provide relatively consistent performance, and generally much more consistency in the deflection, bending and flexure of the head than would be achieved continuing to use the same head throughout the different temperatures.

The testing was performed using two heads of identical physical structure and dimensions, namely, the Razor 2.0 and the Razor Spyne both commercially available from Warrior's Sports, Inc. of Warren, Mich. The Razor 2.0 was constructed from a first material, for example, ST801, as described above, and is generally referred to as a first head in FIGS. 8-14 and below. The Razor Spyne was constructed from a second material, for example, FE8200, as described above, and is generally referred to as a second head in FIGS. 8-14 and below. Of course, the first and second heads can be constructed from materials different from those of the test to yield similar results.

Figure 6:
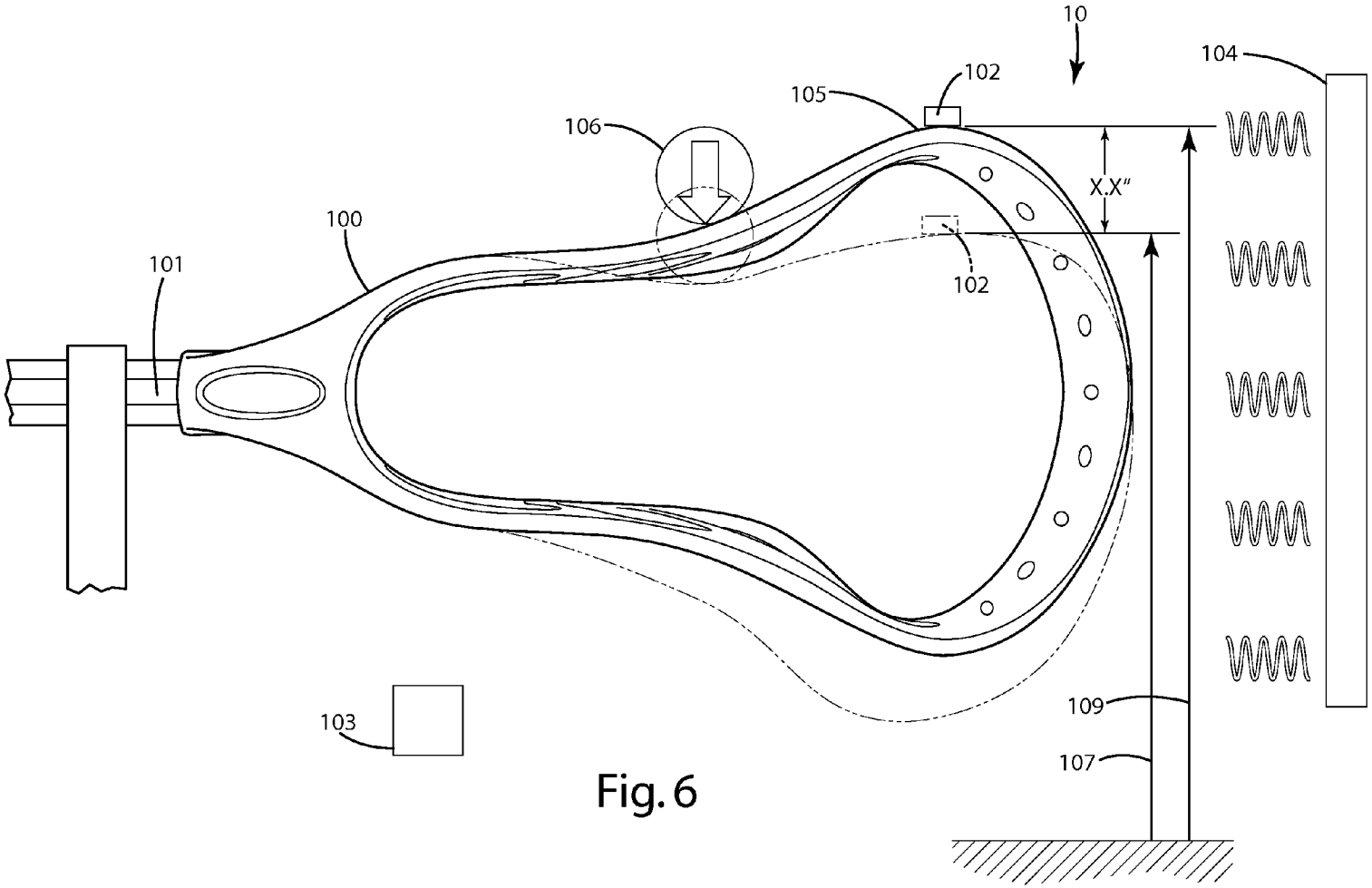
FIG. 6 is an illustration of a comparative force-deflection test equipment used to test deflection of lacrosse heads under different environmental conditions.

The testing included deflecting the heads under different forces at various different temperatures using the equipment and set-up illustrated in FIG. 6. The tested lacrosse heads 100 were separately and independently installed on a fixture 101. The fixture oriented the heads in a generally sideways configuration. A height gauge 102 was placed adjacent the top head, for example, edge 105 of each head as illustrated, and calibrated so that it measured overall deflection of the head, indicated as "X.X"", relative to a fixed reference 108 when a predetermined force was exerted by the force generator 106 on the uppermost sidewall of the respective heads as illustrated. The predetermined force exerted by the force generator 106 ranged from 0 to about 265 Newtons (N). The force generator exerted the force at an increasing rate until a maximum force was achieved on the tested head, that is, the force generator loaded the force on the head. This maximum force was the force at which the head had deflected by 50 millimeters (mm). After the 50 mm deflection was achieved, the force generator decreased the applied force at a predetermined rate back to zero, that is, the force generator unloaded the force from the head, and the deflection as the force decreased was measured. In general, the graphical output of this loading and unloading of the of the heads were loading and unloading stress strain curves, which generally yielded hysteresis loops, which are described below.

In general, predetermined forces were loaded on, then unloaded from, the two heads at various temperatures, specifically 40° F., 72° F., 90° F. and 105° F., for comparison. The temperatures were measured with sensor 103, and the variance in the temperature was achieved with the cooling and/or heating element 104. The deflection of the different heads under the forces at the different temperatures was calculated by subtracting distance 107 from distance 109 at the different temperatures. The results showed that the second material deflects less than the first material at elevated temperatures, and that the second head returns to its original state more quickly than the first head due to the different materials used.

Graphical results of the force-deflection testing of the first head, the Razor 2.0, and the second head, the Razor Spyne under loading and unloading forces and various temperatures is shown at FIGS. 8-14. As can be seen, the graphical representations of the force-deflection tests yielded multiple loading and unloading stress-strain curves, which were combined to generate the illustrated hysteresis loops.

Figure 8:
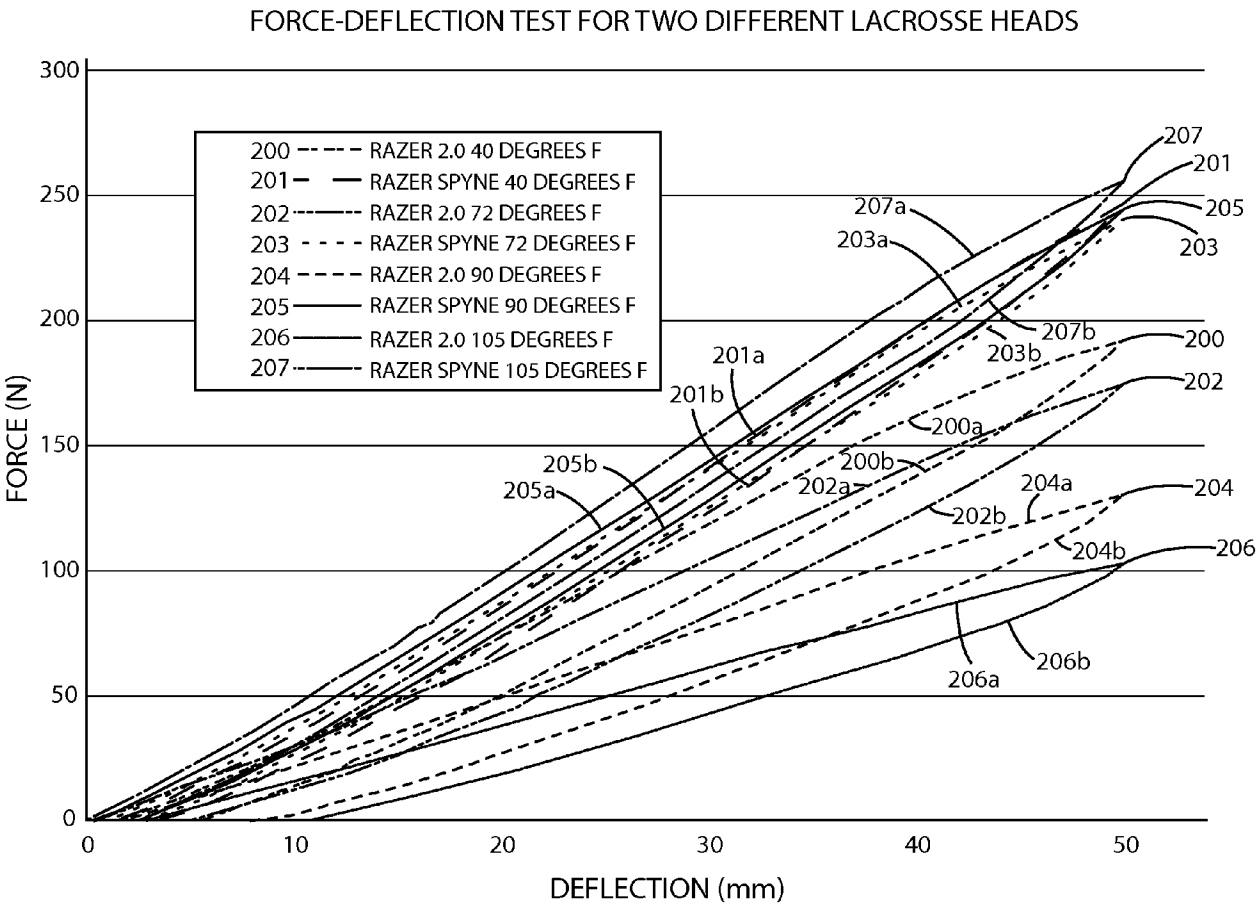
FIG. 8 is a graphical illustration of the results of a force-deflection test for different lacrosse heads at various temperatures.

The cumulative results of the force-deflection tests of the Razor Spyne and the Razor 2.0 at 40° F., 72° F., 90° F. and 105° F., are graphically illustrated in FIG. 8, generally in the form of hysteresis loops for each head at each of the various temperatures. In FIGS. 8-14, the force applied (in Newtons) is indicated on the Y axis, while the amount of deflection of the head (in millimeters) is indicated on the X axis. The legend indicates which loops represent the different heads at the various temperatures.

Figure 9:
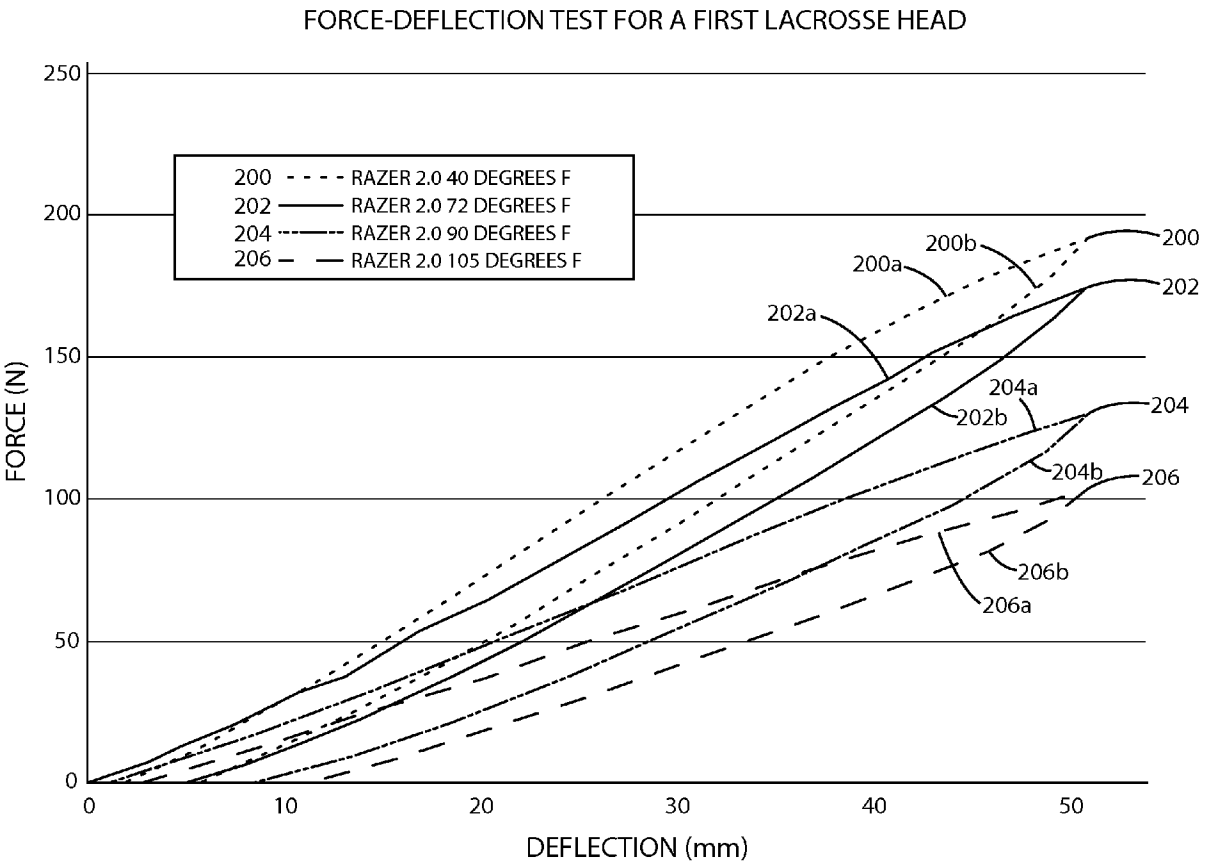
FIG. 9 is a graphical illustration of the test results of a force-deflection test on the first head at various temperatures.

FIG. 9 illustrates the force-deflection test results of the Razor 2.0 at 40° F., 72° F., 90° F. and 105° F. under the range of forces noted in the Y axis, which caused the deflections noted in the X axis. Again, the Razor 2.0 was constructed from a first material, namely ST801. The results are represented by the hysteresis loops 200, 202, 204, and 206. Each of the hysteresis loops are divided into loading curves and unloading curves, for example, curve 206, which tested the Razor Spyne at 105° F. for deflection is divided into a first curve **206*a* which represents the loading of the head via the force generator 106 as shown in FIG. 6. The other portion of the curve 206*b* represents the unloading of the head when force is removed after having been applied to a maximum force on the head by the force generator 106 as shown in FIG. 6. The other hysteresis loops 200, 202 and 204** are similarly divided into loading and unloading portions as illustrated.

In general, as shown in FIG. 9, the Razor 2.0 required a force of about 185 N to about 195 N, optionally about 189 N to about 193 N, to deflect it 50 mm at 40° F. At 72° F., the Razor 2.0 required a force of about 170 to about 175, optionally about 173 to deflect the head 50 mm. At 90° F., the Razor 2.0 required about 125 to about 135 Newtons, optionally about 130 Newtons to deflect the head 50 mm. At 105° F., the Razor 2.0 required the force of about 95 to about 105 Newtons, optionally about 100 to about 103 Newtons, to deflect the head 50 mm. In general, the Razor 2.0 generally exhibited a significant change in the amount of force, from 40° F. to 105° F., to deflect the head the noted distance. For example, the difference between deflecting the head 50 mm at 40° F. and deflecting the head 50 mm at 105° F. was about 90 Newtons, which was observed as an unexpected surprise because there was so much variance the amount of head deflections in only a 65° F. temperature change.

From a performance standpoint, this variance is believed to be indicative of a substantial increase in the flexibility and/or a decrease in rigidity of the Razor 2.0 across the noted temperature change. As a result, it is believed that the first head of the first material performs differently at the higher temperatures. For example, when a lacrosse ball is shot from the head, the head flexes more in the sidewalls, thereby reducing the velocity and/or changing direction of the ball as it exists the head, as compared to exiting of the ball from the same head at lower temperatures. For some lacrosse players, this can be a noticeable and undesirable change in performance characteristics of the head.

Figure 10:
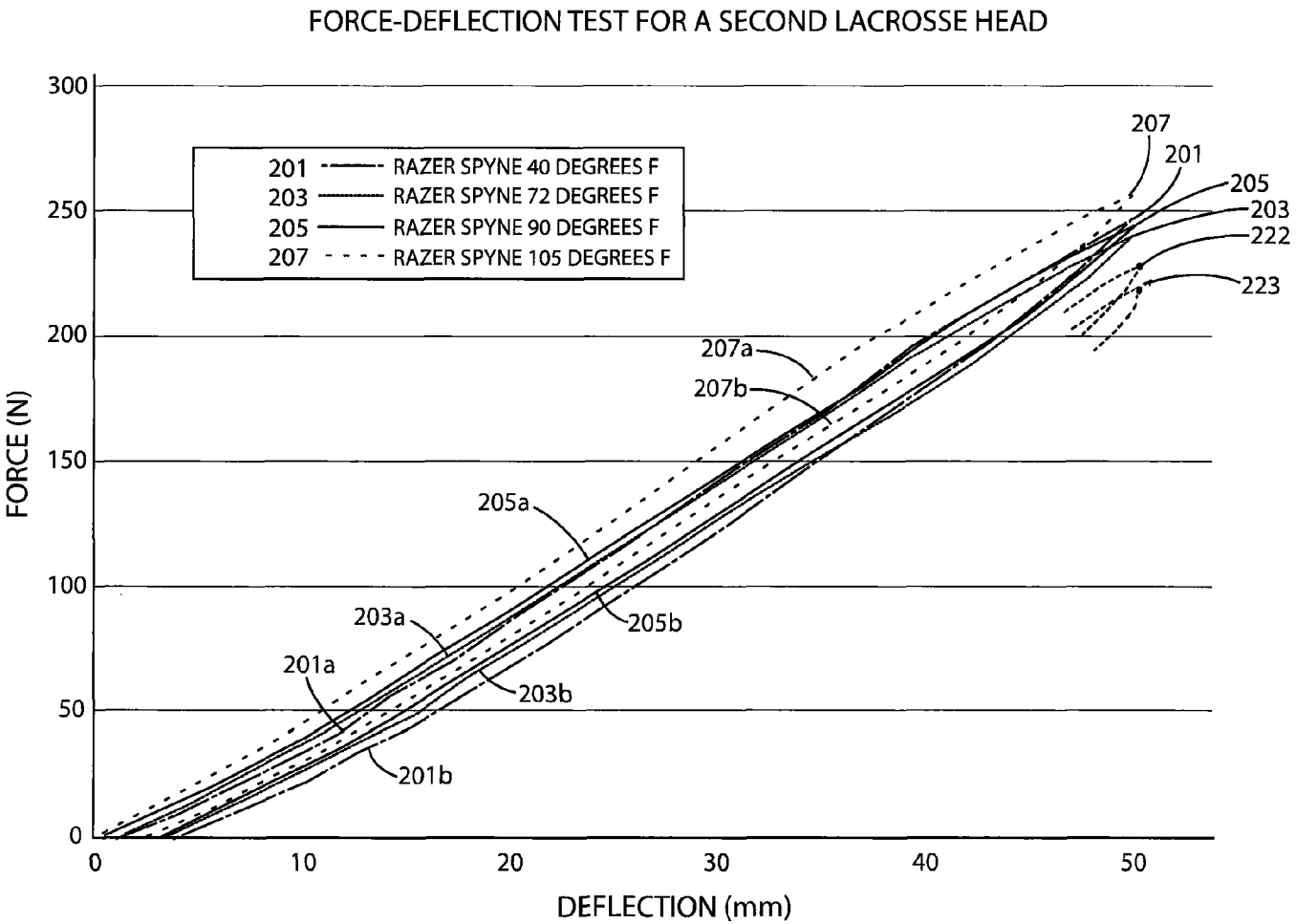
FIG. 10 is a graphical illustration of the test results of a force-deflection test on the second head at various temperatures.
Figure 11:
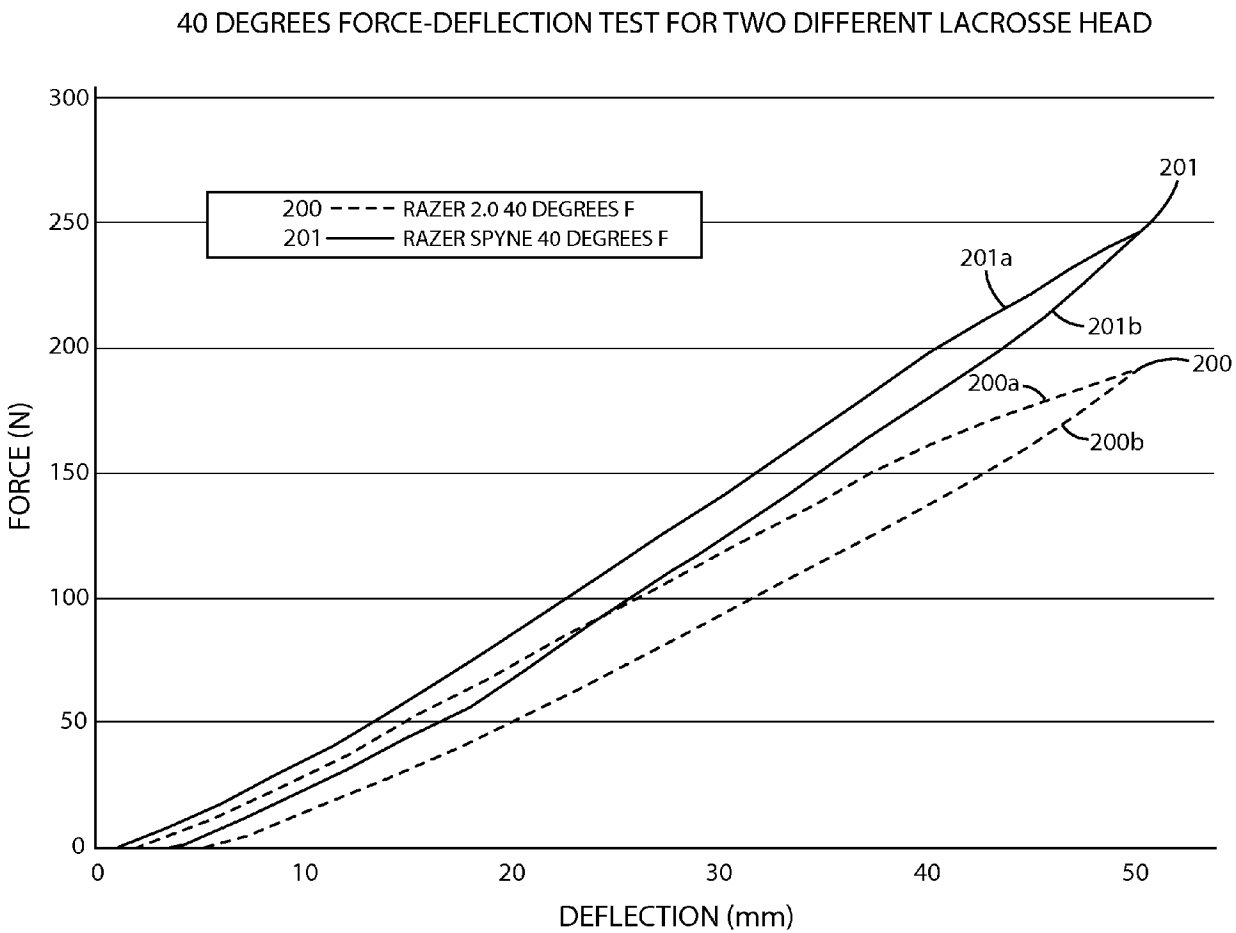
FIG. 11 is a graphical illustration of the force-deflection test results of the first head and second head at 40° F.
Figure 12:
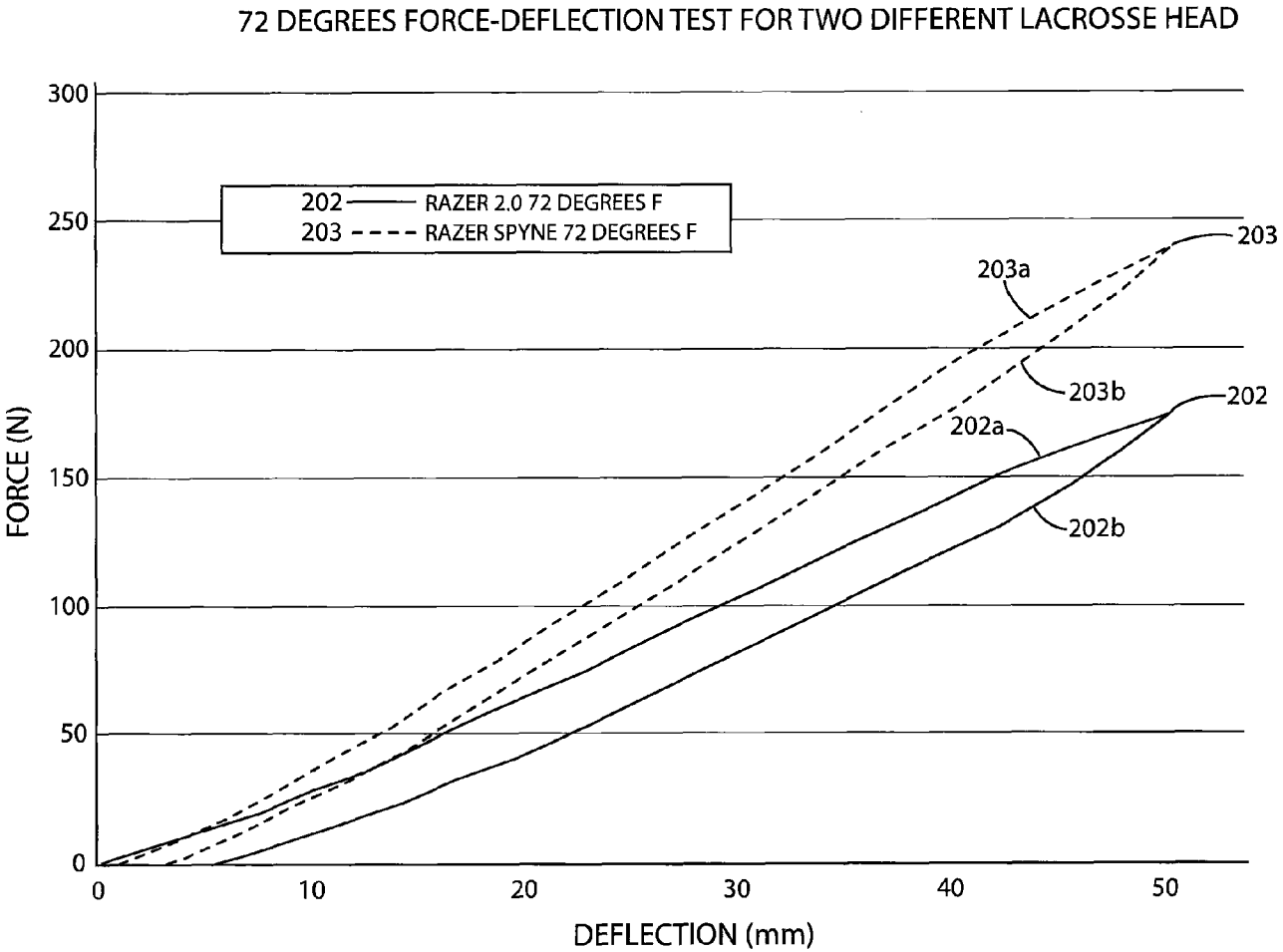
FIG. 12 is a graphical illustration of the force-deflection test results of the first head and second head at 72° F.

In FIG. 10, the force-deflection test results of the Razor Spyne, which again was constructed of the second material, namely, FE8200, are illustrated graphically and represented at the hysteresis loops 201, 203, 205 and 207 at temperatures 40° F., 72° F., 90° F. and 105° F. Each of the hysteresis loops are divided into loading curves and unloading curves, for example, curve 207, which tested the Razor Spyne at 105° F. for deflection is divided into a first curve 207*a* which represents the loading of the head via the force generator 106 as shown in FIG. 6. The other portion of the curve, 207*b*, represents the unloading of the head when force is removed after having been applied to a maximum force on the head by the force generator 106 as shown in FIG. 6. The other hysteresis curves 201, 203 and 205 are similarly divided into loading and unloading portions as illustrated.

As shown in FIG. 10, the Razor Spyne at 40° F. required about 240 to 250, optionally about 246 Newtons to deflect the head 50 mm. At 72° F., the Razor Spyne required about 235 to about 240, optionally about 238 to about 240 Newtons, to deflect the head about 50 mm. At 90° F., the Razor Spyne required about 240 to about 245 Newtons, optionally about 242 Newtons, to deflect the head 50 mm. At 105° F., the Razor Spyne required about 250 to about 255 Newtons to deflect the head 50 mm. With respect to the latter two 50 mm deflection forces, it was noted that these forces were slightly higher than what was expected. For example, because the temperatures were higher, it was expected that the heads would be more flexible at higher temperatures. After further consideration, it was concluded that there may have been a slightly different cooling rate of the tested heads, or the specific crystalline structure of the tested heads caused this variance. Without these variables, it is believed that the entire hysteresis loops 205 and 207 would shift down so their shift points (e.g., the shift from the loading curves 205*a*, 207*a* to the unloading curves 205*b*, 207*b*) would move down to points 222 and 223, respectively, and the curves would fall where illustrated in phantom in FIG. 10. With the readjusted hysteresis loops 205 and 207, it was expected that the Razor Spyne would deflect 50 mm under about 230 to about 235 Newtons at 90° F., and under about 225 to about 230 Newtons at 105° F.

In general, even taking into consideration the variables of different cooling rates and differences in tested heads, the Razor Spyne head constructed from the second material can be expected to deflect 50 mm under forces ranging from about 210 Newtons to about 260 Newtons, optionally about 225 Newtons to about 250 Newtons, throughout the different temperatures of 40° F., 72° F., 90° F. and 105° F., or generally, in the range of 40° F. to about 110° F.

FIGS. 11-14 are graphical illustrations of a direct comparison between the Razor 2.0, constructed from the first material ST801, to the Razor Spyne constructed from the second material FE8200, at each of the individual temperatures, 40° F., 72° F., 90° F. and 105° F. These graphical illustrations illustrate the differences in the hysteresis loops of each of the tested heads. The performance of the Razor 2.0, constructed from the first material, varies considerably in that it deflects a substantially greater distance with only a moderate increase in temperature. In contrast, the Razor Spyne, constructed from the second materials, does not deflect substantially greater distances with moderate increases in temperatures.

Figure 13:
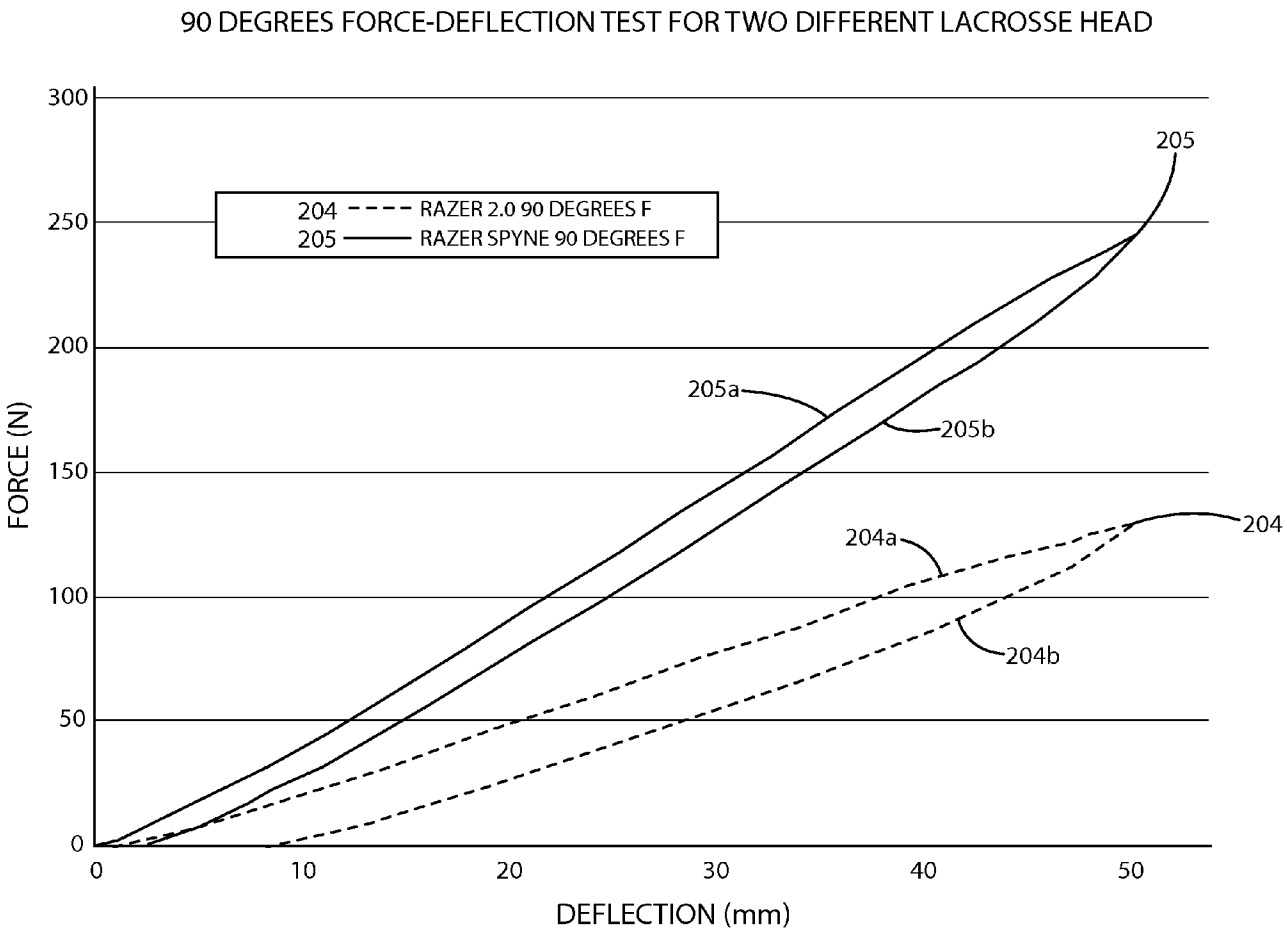
FIG. 13 is a graphical illustration of the force-deflection test results of the first head and second head at 90° F.

As an example, in FIG. 13, the Razor Spyne at 90° F. requires about 246 Newtons to deflect 50 mm, while the Razor 2.0 requires only about 130 to 140 Newtons to deflect the same distance. The amount by which the Razor 2.0 deflects under increasing load and temperature is also substantially greater than the amount which the Razor Spyne increases under increasing load and temperature. This indicates that the Razor 2.0 is more likely to bend at increasing loads at increased temperatures (e.g., about 90° F.) than the Razor Spyne, which can cause undesirable changes in the playing characteristics of the head.

Figure 14:
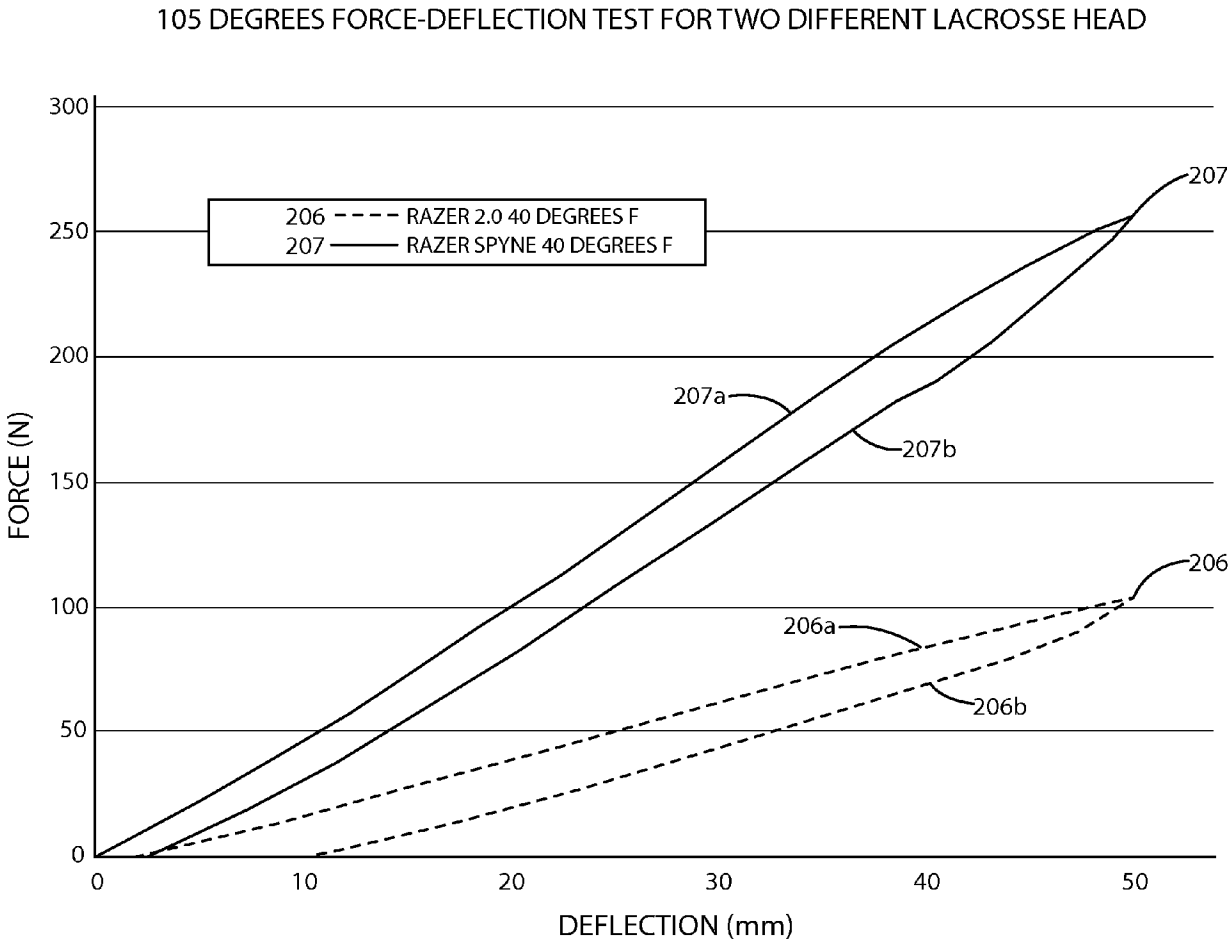
FIG. 14 is a graphical illustration of the force-deflection test results of the first head and second head at 105° F.

FIG. 14 illustrates this even more clearly when the temperature raises another 15° F. to 105° F. There, the Razor 2.0 deflects 50 mm under with only about 100 Newtons, while the Razor Spyne deflects 50 mm under about 250 Newtons. Even if adjusted to compensate for variables, the force would probably be about 225 to about 230 Newtons. This is a difference of about 120 to 130 Newtons to achieve the maximum deflection of 50 mm. Thus, considerably less force will bend and deform the Razor 2.0 than the Razor Spyne at this temperature.

As another example as shown in FIG. 14, at 105° F., the Razor 2.0, constructed from the ST801, deflects nearly one-half to two-thirds more in distance than the Razor Spyne constructed from FE8200, under lesser loads of about 20 to 125 Newtons. This deterioration of the rigidity in the head can cause significant performance changes in the head, which can cause a player to play inconsistently when shooting or passing the lacrosse ball in a game. For example, when shooting a ball from the head constructed from the first material at higher temperatures of, say 105° F., the head may bend and flex under the force, which can cause the ball to be shot from the head at slower speeds, or with an unanticipated spin. Accordingly, although counter intuitive to conventional lacrosse play, it has been determined that the switch from a lacrosse head constructed from the ST801 to a lacrosse head constructed from FE8200 may be advisable at higher temperatures, for example, at, at least about 105° F. Indeed, such a switch may be advisable at the lower temperature of 85° F. to about 90° F., depending on the particular player. Changes at even lower temperatures may be desirable by players who are sensitive to even slight changes in performance of their head.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A method of selecting between different lacrosse heads comprising:

providing a first lacrosse head constructed from a first material, the first lacrosse head including an environmental indicator, the environmental indicator adapted to output different output corresponding to physical changes of the first material of the first lacrosse head, said physical changes corresponding to a change in at least one of flexibility and rigidity of the first lacrosse head;

transforming the environmental indicator so that the environmental indicator outputs at least one of a visual and audible output to indicate a change in the at least one of flexibility and rigidity of the first lacrosse head; and changing from the first lacrosse head to a second lacrosse head constructed from a second material different from the first material in response to the at least one of a visual and audible output;

wherein the second lacrosse head is at least one of less flexible and more rigid than the first lacrosse head when the first and second lacrosse heads are subjected to a temperature above a preselected temperature.

2. The method of claim 1 wherein the environmental indicator is a temperature indicator included in the first material.

3. The method of claim 1 wherein the first lacrosse head has a first elastic modulus when subjected to the preselected temperature, and wherein the second lacrosse head has a second elastic modulus when subjected to the preselected temperature, the first elastic modulus being greater than the second elastic modulus.

4. The method of claim 1 wherein the first material is a 6,6 polyamide and the second material is a polypthalamide.

5. The method of claim 1 wherein the second head includes a temperature indicator.

6. The method of claim 1 wherein the environmental indicator includes a thermally sensitive material that is at least one of mixed with the first material and affixed to the first lacrosse head.

7. The method of claim 1 wherein the output is a visual output that is output when the temperature exceeds the preselected temperature.

8. The method of claim 1 wherein the environmental indicator is a thermochromic material included in the first lacrosse head.

9. A method of using lacrosse heads comprising:

providing a first lacrosse head, a second lacrosse head, and at least one lacrosse handle, each of the first and second lacrosse heads having a different set of material properties, at least one of the first lacrosse head, the second lacrosse head and the lacrosse handle including a temperature indicator; sensing a temperature condition with the temperature indicator, the temperature condition affecting at least one of the material properties of the at least one of the first and second lacrosse heads;

outputting an output with the temperature indicator in response to the sensing of the temperature condition; wherein a lacrosse player selects either the first lacrosse head or the second lacrosse head based on the output; and wherein a lacrosse player engages in a lacrosse activity with the selected first lacrosse head or the second lacrosse head.

10. The method of claim 9, wherein the environmental condition is temperature, wherein the selecting step includes selecting the first lacrosse head when the temperature is below a first temperature and selecting the second lacrosse head when the temperature is above the first temperature, whereby a lacrosse player changes from the first lacrosse head to the second lacrosse head above the first temperature without being affected by a change in performance characteristics of the first lacrosse head, as would be the case if the lacrosse player continued to use the first lacrosse head constructed from the first material at temperatures above the first temperature.

11. The method of claim 10 comprising outputting the output when the temperature is above or below the first temperature.

12. The method of claim 10 wherein the first temperature is at least one of 80° F., 85° F., 90° F., 95° F., 100° F., 105° F., 110° F., 115° F. and 120° F.

13. The method of claim 9 wherein, wherein the second material has second performance characteristics when the second material is above a first temperature, which second performance characteristics mimic first performance characteristics of the first material when the first material is below the first temperature.

14. The method of claim 9 wherein the temperature indicator includes a thermochromic ink that changes appearance above a first temperature.

15. The method of claim 9 wherein the temperature indicator changes color when the lacrosse head is subjected to a particular temperature at which the material changes elasticity.

16. A method of using lacrosse equipment:

providing a first lacrosse head constructed from a first material having an elasticity, the first lacrosse head joined with a lacrosse handle, the first lacrosse head including a scoop joined with sidewalls and a base, at least one of the first lacrosse head and the lacrosse handle including a temperature indicator;

sensing with the temperature indicator at least one of a temperature and a change in the temperature, indicative of a change in the elasticity of the first material from which the first lacrosse head is constructed; and outputting an output with the temperature indicator in response to the sensing of the temperature to alert a lacrosse player to the change in elasticity of the first material from which the first lacrosse head is constructed, wherein the lacrosse player is prompted to select a different, second lacrosse head in response to the output so that the lacrosse player can engage in a lacrosse activity with the second lacrosse head, wherein the second lacrosse head is constructed from a second material that is less elastic than the first material of the first lacrosse head above an elasticity changing temperature.

* * * * *